US005105831A

United States Patent [19]

Banerjee et al.

[11] Patent Number: 5,105,831

[45] Date of Patent: Apr. 21, 1992

[54] SMOKING ARTICLE WITH CONDUCTIVE AEROSOL CHAMBER

[75] Inventors: Chandra K. Banerjee, Pfafftown; Henry T. Ridings, Lewisville; Andrew J. Sensabaugh, Jr.; Michael D. Shannon, both of Winston-Salem, all of N.C.

[73] Assignee: R. J. Reynolds Tobacco Company, Winston-Salem, N.C.

[21] Appl. No.: 121,463

[22] Filed: Nov. 17, 1987

Related U.S. Application Data

[63] Continuation of Ser. No. 790,356, Oct. 23, 1985, abandoned.

[51] Int. Cl.[5] ..... A24B 15/18; A24D 1/18; A24D 1/02

[52] U.S. Cl. ..... 131/194; 131/335; 131/369

[58] Field of Search ..... 131/365, 359, 197, 198, 131/194

[56] References Cited

U.S. PATENT DOCUMENTS

| | | |
|---|---|---|
| Re. 27,214 | 11/1971 | Nakahara . |
| 2,907,686 | 10/1959 | Siegel . |
| 3,219,041 | 11/1965 | Bromberg . |
| 3,258,015 | 6/1966 | Ellis . |
| 3,356,094 | 12/1967 | Ellis . |

FOREIGN PATENT DOCUMENTS

| | | |
|---|---|---|
| 276250 | 1/1964 | Australia . |
| 687136 | 12/1958 | Canada . |
| 0003064 | 7/1979 | European Pat. Off. . |
| 117355 | 12/1983 | European Pat. Off. . |
| 1294351 | 8/1978 | Fed. Rep. of Germany . |
| 42-8684 | 3/1967 | Japan . |
| 13985/3890 | 9/1985 | Liberia . |
| 1185887 | 3/1970 | United Kingdom . |
| 1204018 | 9/1970 | United Kingdom . |
| 1431045 | 4/1972 | United Kingdom . |

OTHER PUBLICATIONS

Tobacco Substitutes, Marshall Sittig, Noyes Data Corporation (1976).

Hackha Chemical Dictionary, 34, 4th Edition (1969).

Lange's Handbook of Chemistry, 10, 272-274, 11th Edition (1973).

G. Hagg, General Inorganic Chemistry at p. 592, John Wiley and Sones (1969).

Ames et al., Mut. Res. 31, 347-364 (1975).

Nago et all., Mut. Res. 42:335 (1977).

Guiness Book of World Records, pp. 242-243, 1985 Edition.

Guiness Book of World Records, p. 194, 1966 Edition.

*Primary Examiner*—V. Millin

*Attorney, Agent, or Firm*—Grover M. Myers; David G. Conlin

[57] ABSTRACT

The present invention is directed to a smoking article which is capable of producing substantial quantities of aerosol, both initially and over the useful life of the product, without significant thermal degradation of the aerosol former and without the presence of substantial pyrolysis or incomplete combustion products.

Preferred embodiments of the present smoking article comprises a short combustible carbonaceous fuel element, a short heat stable, preferably carbonaceous substrate bearing an aerosol forming substance and disposed longitudinally behind the fuel element, an efficient insulating means, and a relatively long mouthend piece. Preferably, the fuel element is provided with a plurality of longitudinally extending passageways which act to control the heat transferred from the burning fuel element to the aerosol generating means, thus preventing the thermal degradation of the aerosol former. The aerosol generating means comprises a conductive, preferably metallic chamber, which at least partially surrounds or encloses the substrate, and is in a conductive heat exchange relationship with the fuel element, and which contains an aerosol forming material.

31 Claims, 3 Drawing Sheets

3,516,417 6/1970 Moses .
3,713,451 1/1973 Bromberg .
3,738,374 6/1973 Bennett .
3,943,941 3/1976 Boyd .
4,044,777 8/1977 Boyd .
4,079,742 3/1978 Ranier .
4,219,032 8/1980 Tabatznik et al. .
4,284,089 8/1981 Ray .
4,286,604 9/1981 Ehretsman .
4,326,544 4/1982 Hardwick .
4,340,072 7/1982 Bolt .
4,347,855 9/1982 Lanzillotti .
4,391,285 7/1983 Burnett .
4,407,308 10/1983 Baker .
4,474,191 10/1984 Steiner .
4,596,258 6/1986 Steiner .

SMOKING ARTICLE WITH CONDUCTIVE AEROSOL CHAMBER

This is a continuation of co-pending application Ser. No. 790,356, filed on Oct. 23, 1985, now abandoned.

BACKGROUND OF THE INVENTION

The present invention relates to a smoking article which preferably produces an aerosol that resembles tobacco smoke and which preferably contains no more than a minimal amount of incomplete combustion or pyrolysis products.

Many smoking articles have been proposed through the years, especially over the last 20 to 30 years. But none of these products has ever realized any commercial success.

Tobacco substitutes have been made from a wide variety of treated and untreated plant material, such as cornstalks, eucalyptus leaves, lettuce leaves, corn leaves, cornsilk, alfalfa, and the like. Numerous patents teach proposed tobacco substitutes made by modifying cellulosic materials, such as by oxidation, by heat treatment, or by the addition of materials to modify the properties of cellulose. One of the most complete lists of these substitutes is found in U.S. Pat. No. 4,079,742 to Rainer et al. Despite these extensive efforts, it is believed that none of these products has been found to be satisfactory as a tobacco substitute.

Many proposed smoking articles have been based on the generation of an aerosol or a vapor. Some of these products purportedly produce an aerosol or a vapor without heat. See, e.g., U.S. Pat. No. 4,284,089 to Ray. However, the aerosols or vapors from these articles fail to adequately simulate tobacco smoke.

Some proposed aerosol generating smoking articles have used a heat or fuel source in order to produce an aerosol. However, none of these articles has ever achieved any commercial success, and it is believed that none has ever been widely marketed. The absence of such smoking articles from the marketplace is believed to be due to a variety of reasons, including insufficient aerosol generation, both initially and over the life of the product, poor taste, off-taste due to the thermal degradation of the smoke former and/or flavor agents, the presence of substantial pyrolysis products and sidestream smoke, and unsightly appearance.

One of the earliest of these proposed articles was described by Siegel in U.S. Pat. No. 2,907,686. Siegel proposed a cigarette substitute which included an absorbent carbon fuel, preferably a 2½ inch (63.5 mm) stick of charcoal, which was burnable to produce hot gases, and a flavoring agent carried by the fuel, which was adapted to be distilled off incident to the production of the hot gases. Siegel also proposed that a separate carrier could be used for the flavoring agent, such as a clay, and that a smoke-forming agent, such as glycerol, could be admixed with the flavoring agent. Siegel's proposed cigarette substitute would be coated with a concentrated sugar solution to provide an impervious coat and to force the hot gases and flavoring agents to flow toward the mouth of the user. It is believed that the presence of the flavoring and/or smoke-forming agents in the fuel of Siegel's article would cause substantial thermal degradation of those agents and an attendant off-taste. Moreover, it is believed that the article would tend to produce substantial sidestream smoke containing the aforementioned unpleasant thermal degradation products.

Another such article was described by Ellis et al. in U.S. Pat. No. 3,258,015. Ellis et al. proposed a smoking article which had an outer cylinder of fuel having good smoldering characteristics, preferably fine cut tobacco or reconstituted tobacco, surrounding a metal tube containing tobacco, reconstituted tobacco, or other source of nicotine and water vapor. On smoking, the burning fuel heated the nicotine source material to cause the release of nicotine vapor and potentially aerosol generating material, including water vapor. This was mixed with heated air which entered the open end of the tube. A substantial disadvantage of this article was the ultimate protrusion of the metal tube as the tobacco fuel was consumed. Other apparent disadvantages of this proposed smoking article include the presence of substantial tobacco pyrolysis products, the substantial tobacco sidestream smoke and ash, and the possible pyrolysis of the nicotine source material in the metal tube.

In U.S. Pat. No. 3,356,094, Ellis et al. modified their original design to eliminate the protruding metal tube. This new design employed a tube made out of a material, such as certain inorganic salts or an epoxy bonded ceramic, which became frangible upon heating. This frangible tube was then removed when the smoker eliminated ash from the end of the article. Even though the appearance of the article was very similar to a conventional cigarette, apparently no commercial product was ever marketed. See also, British Patent No. 1,185,887 which discloses similar articles.

In U.S. Pat. No. 3,738,374, Bennett proposed the use of carbon or graphite fibers, mat, or cloth associated with an oxidizing agent as a substitute cigarette filler. Flavor was provided by the incorporation of a flavor or fragrance into the mouthend of an optional filter tip.

U.S. Pat. Nos. 3,943,941 and 4,044,777 to Boyd et al. and British Patent 1,431,045 proposed the use of a fibrous carbon fuel which was mixed or impregnated with volatile solids or liquids which were capable of distilling or subliming into the smoke stream to provide "smoke" to be inhaled upon burning of the fuel. Among the enumerated smoke producing agents were polyhydric alcohols, such as propylene glycol, glycerol, and 1,3-butylene glycol, and glyceryl esters, such as triacetin. Despite Boyd et al.'s desire that the volatile materials distill without chemical change, it is believed that the mixture of these materials with the fuel would lead to substantial thermal decomposition of the volatile materials and to bitter off tastes. Similar products were proposed in U.S. Pat. No. 4,286,604 to Ehretsmann et al. and in U.S. Pat. No. 4,326,544 to Hardwick et al.

Bolt et al., in U.S. Pat. No. 4,340,072 proposed a smoking article having a fuel rod with a central air passageway and a mouthend chamber containing an aerosol forming agent. The fuel rod preferably was a molding or extrusion of reconstituted tobacco and/or tobacco substitute, although the patent also proposed the use of tobacco, a mixture of tobacco substitute material and carbon, or a sodium carboxymethylcellulose (SCMC) and carbon mixture. The aerosol forming agent was proposed to be a nicotine source material, or granules or microcapsules of a flavorant in triacetin or benzyl benzoate. Upon burning, air entered the air passage where it was mixed with combustion gases from the burning rod. The flow of these hot gases reportedly ruptured the granules or microcapsules to release the volatile material. This material reportedly formed an aerosol and/or was transferred into the mainstream aerosol. It is believed that the articles of Bolt et al., due in part to the long fuel rod, would produce insufficient aerosol from the aerosol former to be acceptable, especially in the early puffs. The use of microcapsules or granules would further impair aerosol delivery because of the heat needed to rupture the wall material. Moreover, total aerosol delivery would appear dependent on the use of tobacco or tobacco substitute materials, which would provide substantial pyrolysis products and sidestream smoke which would not be desirable in this type smoking article.

U.S. Pat. No. 3,516,417 to Moses proposed a smoking article, with a tobacco fuel, which was identical to the article of Bolt et al., except that Moses used a double density plug of tobacco in lieu of the granular or microencapsulated flavorant of Bolt et al. See FIG. 4, and col. 4, lines, 17–35. Similar tobacco fuel articles are described in U.S. Pat. No. 4,347,855 to Lanzillotti et al. and in U.S. Pat. No. 4,391,285 to Burnett et al. European Patent Appln. No. 117,355, to Hearn, describes similar smoking articles having a pyrolyzed ligno-cellulosic heat source having an axial passageway therein. These articles would suffer many of the same problems as the articles proposed by Bolt et al.

Steiner, in U.S. Pat. No. 4,474,191 describes "smoking devices" containing an air-intake channel which during the lighting of the device, is completely isolated from the combustion chamber by a fire resistant wall. To assist in the lighting of the device, Steiner provides means for allowing the brief, temporary passage of air between the combustion chamber and the air-intake channel. Steiner's heat conductive wall also serves as a deposition area for nicotine and other volatile or sublimable tobacco simulating substances. In one embodiment (FIGS. 9 and 10), the device is provided with a hard, heat transmitting envelope. Materials reported to be useful for this envelope include ceramics, graphite, metals, etc. In another embodiment, Steiner envisions the replacement of his tobacco (or other combustible material) fuel source with some purified cellulose-based product in an open cell configuration, mixed with activated charcoal. This material, when impregnated with an aromatic substance is stated to dispense a smoke-free, tobacco-like aroma.

Thus, despite decades of interest and effort, there is still no smoking article on the market which provides the benefits and advantages associated with conventional cigarette smoking, without delivering considerable quantities of incomplete combustion and pyrolysis products.

SUMMARY OF THE INVENTION

The present invention relates to a smoking article which is capable of producing substantial quantities of aerosol, both initially and over the useful life of the product, preferably without significant thermal degradation of the aerosol former and without the presence of substantial pyrolysis or incomplete combustion products or sidestream smoke. Preferred articles of the present invention are capable of providing the user with the sensations and benefits of cigarette smoking without the necessity of burning tobacco.

These and other advantages are obtained by providing a smoking article, preferably of the cigarette type, which generally utilizes a short, i.e., less than about 30 mm long, preferably carbonaceous, fuel element, a physically separate aerosol generating means including an aerosol forming material, and a heat conductive container which encloses the aerosol forming material and which is preferably spaced from the lighting end of the fuel element. Preferably, the heat conductive, container is formed from a single conductive, preferably metallic, element having a diameter of from about 3 to 8 mm, and a length of from about 10 to 50 mm. Alternatively, the container may be formed from a plurality of heat conductive elements, arranged so as to form a container. Preferably, the aerosol generating means is in a conductive heat exchange relationship with the fuel element and/or at least a portion of the fuel element is provided with a resilient insulating jacket to reduce radial heat loss.

Upon lighting, the fuel element generates heat which is used to volatilize the aerosol forming materials in the aerosol generating means, a process which is enhanced by the use of a conductive container for the aerosol forming material. These volatile materials are then delivered to the user in the form of a "smoke-like" aerosol through the mouth end of the article.

In certain embodiments of the present invention, the container for the aerosol generating means helps to prevent the migration of the aerosol forming material into the fuel element. In other embodiments, the container helps to prevent migration of the aerosol former to other components comprising the smoking article. The container more easily permits the use of particulate substrates as carriers for the aerosol forming substances. Likewise, semi-solids, semi-liquids, and like materials may be employed as aerosol forming materials, with or without a substrate, when a container is present. The heat conductive container or chamber also aids in rapidly bringing the aerosol generating means to a sufficiently high temperature to cause volatilization of the aerosol forming material, especially because the conductive chamber surrounds the aerosol forming material, and due to the conductive nature of the materials used to construct the container, it causes rapid and nearly even heating of the substances in the container. In addition, the use of one or more heat conducting materials in the formation of the container affords the ability of tailoring the heat transfer characteristics of the container, for example, to prevent the transfer of too much heat to aerosol formers having low boiling points or otherwise high volatility. The use of a container for the aerosol generating means also provides a means for controlling the pressure drop in the article. By selecting the number, position and size of passageways in the container, the pressure drop can be tailored as desired. The preferred use of a metallic container which overlaps the rear portion of the fuel element also provides a heat sink for the high temperature generated by the burning fuel element which aids in extinguishing the fuel element when the fire cone reaches the point of contact with the container. Finally, the use of a container helps simplify the manufacture of the articles of the present invention by reducing the number of necessary elements and/or manufacturing steps.

The fuel elements useful in practicing this invention are preferably less than about 20 mm in length, more preferably less than about 15 mm in length, from 2 to 8 mm in diameter, and have a density of at least about 0.5 g/cc. Preferred fuel elements are normally provided with one or more longitudinal passageways, more preferably from 5 to 9 passageways, which help to control the transfer of heat from the fuel element to the aerosol forming materials.

The conductive heat exchange relationship employed in preferred embodiments is preferably achieved by providing a heat conducting member, such as a metal conductor, which contacts at least a portion of both the fuel element and the aerosol generating means, and which preferably forms the container for the aerosol forming material. This heat conducting member is advantageously spaced or recessed at least about 3 mm or more, preferably at least about 5 mm or more, from the lighting end of the fuel element. Use of such a recessed member avoids interference with the lighting and/or burning of the fuel element and avoids any protrusion of the conducting member after the fuel element has been consumed.

In addition, at least a part of the fuel element is preferably provided with a peripheral insulating member, such as a jacket of insulating fibers, the jacket preferably being resilient and at least about 0.5 mm thick, which reduces radial heat loss and assists in retaining and directing heat from the fuel element toward the aerosol generating means and may aid in reducing any fire causing propensity of the fuel element. The insulating member preferably overwraps at least part of the fuel element, and advantageously at least part of the container for the aerosol generating means, which helps simulate the feel of a conventional cigarette. Different materials may be used to insulate the fuel element and the aerosol generating means.

Preferred smoking articles of the type described herein are particularly advantageous because the hot, burning fire cone is always close to the aerosol generating means, which maximizes heat transfer thereto and maximizes the resultant production of aerosol, especially in embodiments which are provided with a multiple passageway fuel element, heat conducting member, and/or an insulating member. In addition, because the aerosol forming substance is physically separate from the fuel element, it is exposed to substantially lower temperatures than are present in the burning fire cone, thereby minimizing the possibility of thermal degradation of the aerosol former.

The smoking article of the present invention is normally provided with a mouthend piece including means, such as a longitudinal passageway, for delivering the aerosol produced by the aerosol generating means to the user. Preferably, the mouthend piece includes a resilient outer member, such as an annular section of cellulose acetate tow, to help simulate the feel of a conventional cigarette. Advantageously, the article has the same overall dimensions as a conventional cigarette, and as a result, the mouthend piece and the aerosol delivery means usually extend over about one-half or more of the length of the article. Alternatively, the fuel element and the aerosol generating means may be produced without a built-in mouthend piece or aerosol delivery means, for use with a separate, disposable or reusable mouthend piece, e.g., a cigarette holder.

The smoking article of the present invention may also include a charge of tobacco which is used to add tobacco flavors to the aerosol. Advantageously, the tobacco may be placed at the mouthend, or around the periphery, of the container for the aerosol generating means, and/or it may be mixed with a carrier for the aerosol forming substance. Other substances, such as flavoring agents, may be incorporated in a similar manner. In some embodiments, a tobacco charge may be used as the carrier for the aerosol forming substance. Tobacco, a tobacco flavor extract, or other flavoring agents, may alternatively, or additionally, be incorporated in the fuel element to provide additional tobacco flavors and/or aromas.

Preferred embodiments of this invention are capable of delivering at least 0.6 mg of aerosol, measured as wet total particulate matter (WTPM), in the first 3 puffs, when smoked under FTC smoking conditions, which consist of a 35 ml puff volume of two seconds duration, separated by 58 seconds of smolder. More preferably, embodiments of the invention are capable of delivering 1.5 mg or more of aerosol in the first 3 puffs. Most preferably, embodiments of the invention are capable of delivering 3 mg or more of aerosol in the first 3 puffs when smoked under FTC smoking conditions. Moreover, preferred embodiments of the invention deliver an average of at least about 0.8 mg of WTPM per puff for at least about 6 puffs, preferably at least about 10 puffs, under FTC smoking conditions.

In addition to the aforementioned benefits, preferred smoking articles of the present invention are capable of providing an aerosol which is chemically simple, consisting essentially of air, oxides of carbon, water, the aerosol former, any desired flavors or other desired volatile materials, and trace amounts of other materials. This aerosol has no significant mutagenic activity as measured by the Ames Test. In addition, preferred articles may be made virtually ashless, so that the user does not have to remove any ash during use.

As used herein, and only for the purposes of this application, "aerosol" is defined to include vapors, gases, particles, and the like, both visible and invisible, and especially those components perceived by the user to be "smoke-like", generated by action of the heat from the burning fuel element upon substances contained within the container for the aerosol generating means, or elsewhere in the article. As so defined, the term "aerosol" also includes volatile flavoring agents and/or pharmacologically or physiologically active agents, irrespective of whether they produce a visible aerosol.

As used herein, the phrase "conductive heat exchange relationship" is defined as a physical arrangement of the aerosol generating means and the fuel element whereby heat is transferred by conduction from the burning fuel element to the aerosol generating means substantially throughout the burning period of the fuel element. Conductive heat exchange relationships can be achieved by placing the aerosol generating means in contact with the fuel element and thus in close proximity to the burning portion of the fuel element, and/or by utilizing a conductive member to carry heat from the burning fuel to the aerosol generating means. Preferably both methods of providing conductive heat transfer are used.

As used herein, the term "carbonaceous" means primarily comprising carbon.

As used herein, the term "insulating member" applies to all materials which act primarily as insulators. Preferably, these materials do not burn during use, but they may include slow burning carbons and like materials, as well as materials which fuse during use, such as low temperature grades of glass fibers. Suitable insulators have a thermal conductivity in g-cal/(sec)($cm^2$)(°C./cm), or less than about 0.05, preferably less than about 0.02, most preferably less than about 0.005. See, *Hackh's Chemical Dictionary* 34 (4th ed., 1969) and Lange's *Handbook of Chemistry* 10, 272–274 (11th ed., 1973).

The preferred smoking articles of the present invention are described in greater detail in the accompanying drawings and in the detailed description of the invention which follow.

DETAILED DESCRIPTION OF THE PREFERRED EMBODIMENTS

Figure 1:
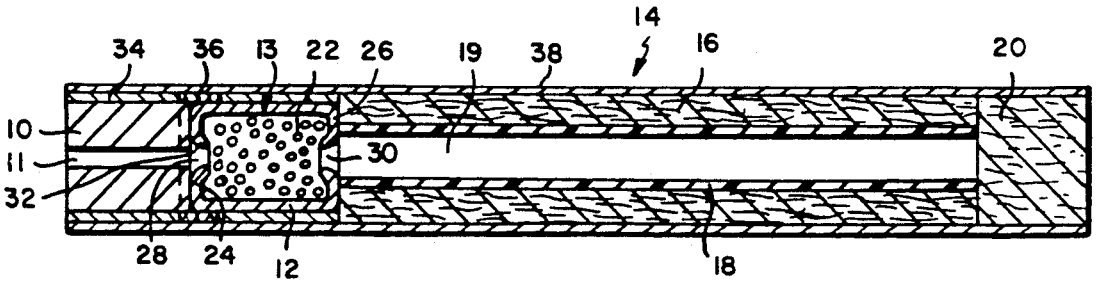
FIGS. 1 through 6 are longitudinal sectional views of various embodiments of the invention.

The embodiment of the invention illustrated in FIG. 1, which has about the same diameter as a conventional cigarette, includes a short, combustible carbonaceous fuel element 10, an abutting container for the aerosol generating means in the form of a heat conductive, preferably metallic, macrocapsule 12, and mouthend piece 14, which comprises a resilient cellulose acetate tow outer layer 16 surrounding a plastic tube 18 made of e.g., polypropylene, Mylar, or Nomex, which forms an aerosol delivery passage 19. The mouthend piece provides aerosol passageway 19 and has a low efficiency cellulose acetate filter element, 20 at the mouth end.

In this embodiment, fuel element 10 is an extruded nonactivated carbon, which is provided with one longitudinally extending passageway 11. Aerosol generating means 13 includes a plurality of granular carbon particles 22 coated or impregnated with an aerosol forming substance, such as propylene glycol, glycerin, or a mixture thereof.

The macrocapsule 12 is a unitary metallic, e.g. aluminum, container, about 7 to 8 mm in diameter, which is crimped at ends 24 and 26 to enclose the substrate material and to inhibit migration of the aerosol former. Passageways 28 and 30 are provided to permit the passage of air and the aerosol forming substance. The crimped end 24, nearest the fuel element, preferably abuts the rear end of the fuel element thereby providing for conductive heat transfer. Void space 32 formed at end 24 also helps prevent migration of the aerosol former.

The macrocapsule and fuel element 10 may be united by a conventional cigarette paper 34, as illustrated in the drawing, by a perforated ceramic paper, or by a foil strip. If cigarette paper is used, a strip 36 near the rear end of the fuel should be printed or treated with sodium silicate or other known materials which cause the paper to extinguish. As illustrated, the entire length of the article is overwrapped with conventional cigarette paper 38.

Figure 2:
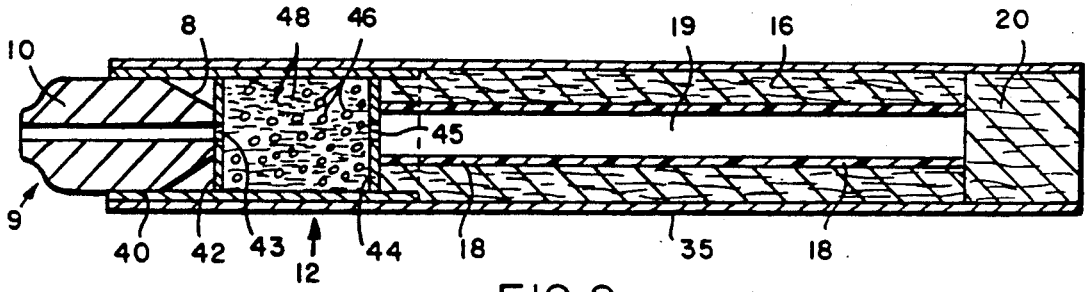

FIG. 2 illustrates an embodiment of the present invention utilizing a pressure formed carbonaceous fuel element 10. In this embodiment, the fuel element has a tapered lighting end 9 for easier lighting and a tapered rear end 8 for easy fitting into tubular foil wrapper 40. Abutting the rear end of the fuel element is an aluminum disc 42 with a center passageway 43. A second aluminum disc 44 with passageway 45 is located near the mouthend of tubular foil wrapper 40. This combination of elements, discs 42 and 44 and tubular foil wrapper 40, form the container 12 for the aerosol generating means. The tubular foil wrapper 40 extends from the rear periphery of the fuel element to slightly beyond the second aluminum disc 44. Located within the container is a mixture of a particulate substrate 46 loaded with one or more aerosol forming materials and tobacco 48. This embodiment also includes a mouthend piece comprising a hollow cellulose acetate rod 16 with an internal plastic, e.g., polypropylene or Mylar, tube 18, and a cellulose acetate filter piece 20. The entire length of the article may be overwrapped with cigarette paper 35.

Figure 3:
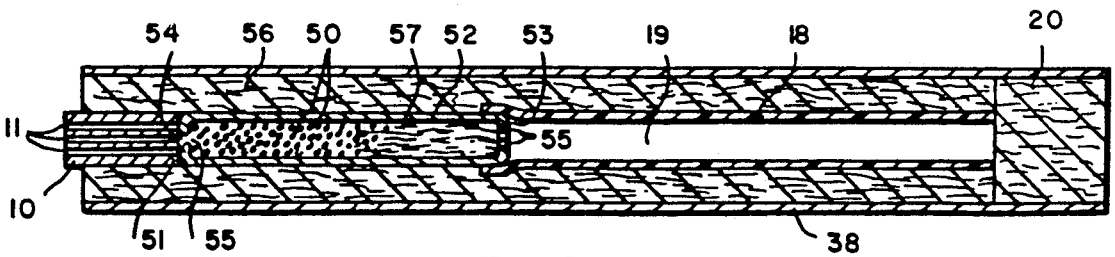
Figure 3A:
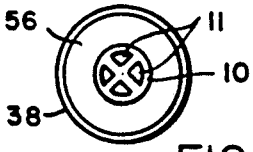
FIGS. 3A, 4A, 4B, 5A, 5B and 6A illustrate several fuel element passageway configurations suitable for use with the articles of the present invention.

In the embodiment shown in FIG. 3, an extruded carbonaceous fuel element 10 is employed, with four distinct passageways 11, each having a "wedge shape" or segment configuration as shown in FIG. 3A. The aerosol generating means comprises a granular alumina substrate 50 which includes one or more aerosol forming substances. This substrate is contained within heat conductive container 52 formed from a unitary metal tube crimped at its ends to form walls 51 and 53, to enclose substrate 50 and to inhibit migration of the aerosol former. Crimped end 51, at the fuel end, preferably abuts the rear end of the fuel element to provide conductive heat transfer. Void space 54 formed at end 51 also helps to inhibit migration of the aerosol former to the fuel element. Passageways 55 are provided to permit passage of air and the aerosol forming substance. The heat conductive container 52 may also enclose a mass of tobacco 57 which may be mixed with the substrate or used in lieu thereof.

In this embodiment a resilient fibrous insulating jacket 56, formed from glass fibers, extends from the lighting end of fuel element 10 to the cellulose acetate filter plug 20. A plastic tube 18, e.g., polypropylene, Mylar, Nomex, or like material, is located inside fiber jacket 56, between heat conductive container 52 and filter element 20, providing a passageway 19 for the aerosol forming substance. This embodiment is overwrapped with cigarette paper 38.

Figure 4:
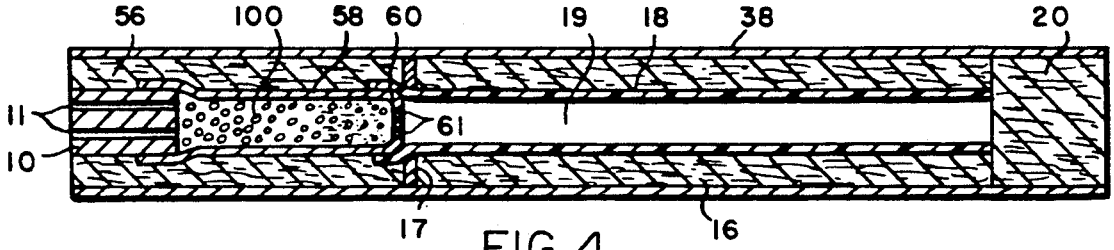
Figure 4A:
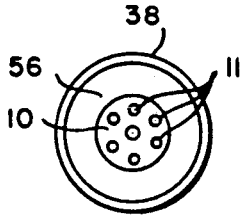
Figure 4B:
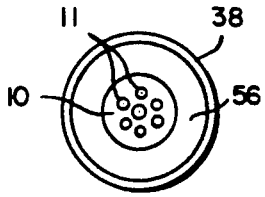

In the embodiment shown in FIG. 4, an extruded carbonaceous fuel element 10 is provided with seven passageways 11. FIGS. 4A and 4B illustrate two different passageway configurations useful in the articles of the present invention. In this embodiment, the container for the aerosol generating means comprises heat conductive container 58 which encloses a substrate 100 of particulate carbon or alumina, densified tobacco, a densified mixture of tobacco and carbon, or a mixture thereof, which includes an aerosol forming substance. As illustrated, one end of heat conductive container 58 overlaps the rear periphery of fuel element 10. The opposite end of container 58 is crimped to form wall 60, having a plurality of passageways 61, thus permitting passage of air, the aerosol forming substance, and/or tobacco flavors. Plastic tube 18 overlaps (or abuts) walled end 60 of heat conductive container 58 and forms an aerosol delivery passageway 19. One or more layers of insulating fibers 56 are wrapped around fuel element 10 and heat conductive container 58, to form a resilient jacket about the diameter of a conventional cigarette. Plastic tube 18 is surrounded by a section of resilient high density cellulose acetate tow 16. A layer of glue 17, may be applied to the fuel end of tow 16 to seal the tow and block air flow therethrough. A filter element 20 is located contiguous to the mouth end of tow 16. As illustrated, the article, or segments thereof, is overwrapped with one or more layers of cigarette paper 38.

Figure 5:
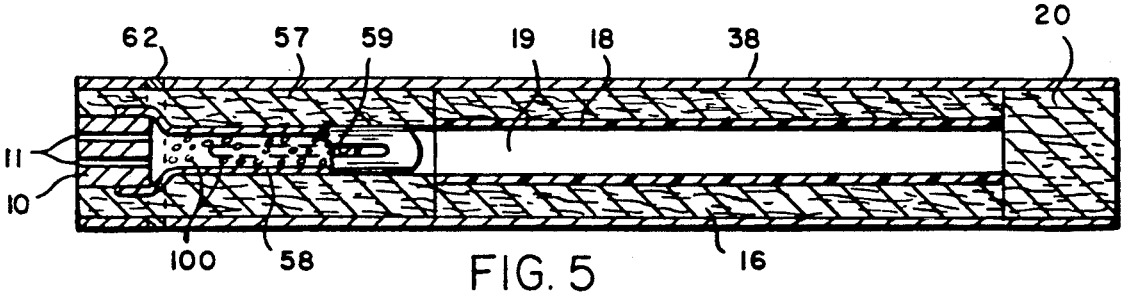

The embodiment illustrated in FIG. 5 is similar to that of FIG. 4, except that the extruded carbonaceous fuel source 10 has nine distinct passageways 11 (see FIG. 5A), and jacket 57 comprises tobacco or an admixture of tobacco and insulating fibers such as glass fibers. As illustrated, the jacket extends just beyond the mouth end of the container for substrate 100. In embodiments of this type the container is preferably provided with longitudinal slots 59 on its periphery, in lieu of passages 61, so that the vapors from the aerosol generating means pass through the annular section of tobacco 57 which surrounds the container. In embodiments of this type, it is highly preferable to treat a portion 62 of the cigarette paper overwrap near the rear end of the fuel with a material such as sodium silicate to help prevent burning of the tobacco behind the exposed portion of the fuel element. Alternatively, the tobacco jacket itself may be treated with a burn modifier to prevent burning of the tobacco which surrounds the aerosol generator.

Figure 5A:
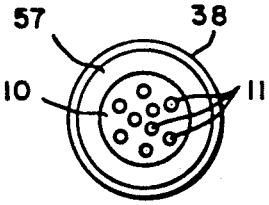
Figure 5B:
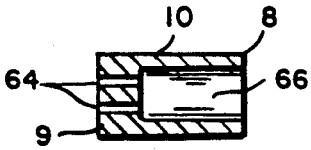

FIG. 5B illustrates an alternative fuel element passageway configuration suitable for use in the smoking articles of the present invention. Three or more, preferably seven to nine, passageways 64 begin at lighting end 9 of fuel element 10 and pass only partially therethrough. At a point within the body of fuel element 10, the passageways 64 merge with a large cavity 66 which extends to the mouth end 8 of fuel element 10.

Figure 6:
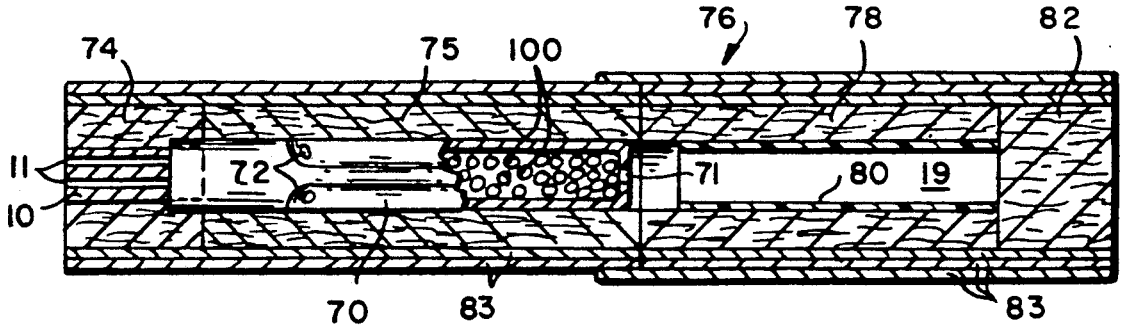
Figure 6A:
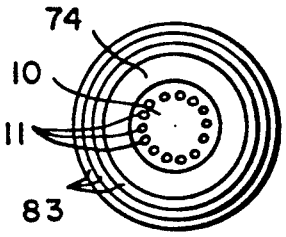

FIG. 6 illustrates another jacketed embodiment of the smoking article of the present invention. As illustrated in FIG. 6A, fuel element 10 is provided with a plurality of passageways 11, situated near the outer edge of the fuel element. Overlapping the mouth end of fuel element 10 is a heat conductive capsule 70 which contains a substrate material 100. Preferred substrates which may be utilized in capsule 70 include granular carbon, granular alumina, tobacco or mixtures thereof.

Figure 6B:
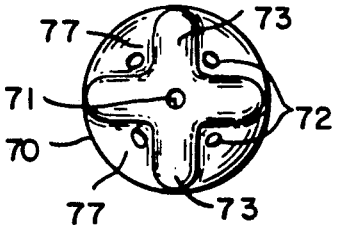
FIG. 6B is an enlarged end view of the conductive container of FIG. 6.

The rear portion of the capsule is crimped into a lobe-shaped configuration, as shown in FIG. 6B, in which each of the lobes or ribs 73 is separated by an indented groove 77. A passageway 71 is provided at the mouth end of the capsule in the center of the crimped tube, as illustrated. Four additional passageway 72 are provided at the transition points between the grooved and the ungrooved portion of the capsule.

In this embodiment, the periphery of the fuel element is surrounded by a resilient jacket 74 of glass insulating fibers, and capsule 70 is surrounded by a jacket of tobacco 75. At the mouth end of the tobacco jacket is a mouthend piece 76 comprised of a cellulose acetate cylinder 78, a centrally located plastic tube 80, and a low efficiency cellulose acetate filter piece 82. As illustrated, the article, or portions thereof, is overwrapped with one or more layers of cigarette paper 83.

As illustrated, the capsule end of plastic tube 80 does not abut the capsule. Thus, vapors flowing through passages 72 and tobacco jacket 75 flow into tube 80 where the tobacco jacket abuts the cellulose acetate cylinder 78 and pass to the user via the defined aerosol delivery passageway 19.

Upon lighting any of the aforesaid embodiments, the fuel element burns, generating the heat used to volatilize the aerosol forming substance or substances in the aerosol generating means. Because the preferred fuel element is relatively short, the hot, burning fire cone is always close to the aerosol generating means, which maximizes heat transfer to the aerosol generating means, and the resultant production of aerosol, especially when the preferred heat conducting member is used. Because of the small size and burning characteristics of the preferred fuel elements employed in the present invention, the fuel element usually begins to burn over substantially all of its exposed length within a few puffs. Thus, that portion of the fuel element adjacent to the aerosol generator becomes hot quickly, which significantly increases heat transfer to the aerosol generator, especially during the early puffs. Because the preferred fuel element is so short, there is never a long section of nonburning fuel to act as a heat sink, as was common in previous thermal aerosol articles.

Heat transfer is enhanced by the heat conductive material in the conductive container for the aerosol forming substances, which aids in the distribution of heat to the portion of the aerosol forming substance which is physically remote from the fuel. This helps produce good aerosol delivery in the early puffs.

Heat transfer is also enhanced by the preferred heat conducting member, which may form part of the conductive container, which helps transfer heat from the fuel element to the conductive container which encloses the aerosol forming substances.

The control of heat transfer may also be aided by the use of an insulating member or members as a peripheral overwrap over at least a part of the fuel element, and advantageously over at least a part of the container for the aerosol generating means. Such members help ensure good aerosol production by retaining and directing much of the heat generated by the burning fuel element toward the aerosol generating means.

The control of heat transfer from the fuel element to the aerosol generating means may also be aided by the presence of a plurality of passageways in the fuel element, which allow the rapid passage of hot gases to the aerosol generator, especially during puffing.

Because the aerosol forming substance is physically separate from the fuel element, the aerosol forming substance is exposed to substantially lower temperatures than are generated by the burning fuel, thereby minimizing the possibility of its thermal degradation. This also results in aerosol production almost exclusively during puffing, with little or no aerosol production from the aerosol generating means during smolder. In addition, the preferred use of a carbonaceous fuel element eliminates the presence of substantial pyrolysis or incomplete combustion products and the presence of substantial sidestream aerosol.

In the preferred embodiments of the invention, the short carbonaceous fuel element, the insulating jacket, the recessed heat conducting member and/or the passageways in the fuel element cooperate with the heat conductive elements of the container for the aerosol generating means to provide a system which is capable of producing substantial quantities of aerosol, on virtually every puff. The close proximity of the fire cone to the aerosol generating means after a few puffs, together with the conductive elements of the container and the insulating jacket and/or conducting member, result in high heat delivery both during puffing and during the relatively long period of smolder between puffs.

While not wishing to be bound by theory, it is believed that the aerosol generating means is maintained at a relatively high temperature between puffs, and that the additional heat delivered during puffs, which is significantly increased by the preferred passageways in the fuel element, is primarily utilized to vaporize the aerosol forming substance. This increased heat transfer makes more efficient use of the available fuel energy, reduces the amount of fuel needed, and helps deliver early aerosol. Furthermore, the conductive heat transfer utilized in the present invention is believed to reduce the carbon fuel combustion temperature which, it is further believed, reduces the $CO/CO_2$ ratio in the combustion products produced by the fuel. See, e.g., G. Hagg, *General Inorganic Chemistry*, at p. 592 (John Wiley & Sons, 1969).

In general, the combustible fuel elements which may be employed in practicing the invention have a diameter no larger than that of a conventional cigarette (i.e., less than or equal to about 8 mm), and are generally less than about 30 mm long. Advantageously the fuel element is about 20 mm or less in length, preferably about 15 mm or less in length. Advantageously, the diameter of the fuel element is between about 3 to 7 mm, preferably about 4 to 5 mm. The density of the fuel elements employed herein may range from about 0.5 g/cc to about 1.5 g/cc, as measured, e.g., by mercury displacement. Preferably, the density is greater than about 0.7 g/cc, more preferably greater than about 0.8 g/cc.

The preferred fuel elements employed herein are primarily formed of a carbonaceous material. Carbonaceous fuel elements are preferably from about 5 to 15 mm, more preferably, from about 8 to 12 mm in length. Preferably, the density is greater than 0.7 g/cc. Carbonaceous fuel elements having these characteristics are sufficient to provide fuel for at least about 7 to 10 puffs, the normal number of puffs generally obtained by smoking a conventional cigarette under FTC conditions.

Preferably, the carbon content of these fuel elements is at least 60 to 70%, most preferably about 80% or more, by weight. High carbon content fuel elements are preferred because they produce minimal pyrolysis and incomplete combustion products, little or no visible sidestream smoke, and minimal ash, and have high heat capacity. However, lower carbon content fuel elements e.g., about 50 to 60% carbon by weight, are within the scope of this invention, especially where a minor amount of tobacco, tobacco extract, or a nonburning inert filler is used.

Also, while not preferred, other fuel materials may be employed, such as molded or extruded tobacco, reconstituted tobacco, tobacco substitutes, and the like, provided that they generate and provide sufficient heat to the aerosol generating means to produce the desired level of aerosol from the aerosol forming material, as discussed above. The density of the fuel used should be above about 0.5 g/cc., preferably above about 0.7 g/cc., which is higher than the densities normally used in conventional smoking articles. Where such other materials are used, it is much preferred to include carbon in the fuel, preferably in amounts of at least about 20 to 40% by weight, more preferably at least about 50% by weight, and most preferably at least about 65 to 70% by weight, the balance being the other fuel components, including any binder, burn modifiers, moisture, etc.

The carbonaceous materials used in or as the preferred fuel element may be derived from virtually any of the numerous carbon sources known to those skilled in the art. Preferably, the carbonaceous material is obtained by the pyrolysis or carbonization of cellulosic materials, such as wood, cotton, rayon, tobacco, coconut, paper, and the like, although carbonaceous materials from other sources may be used.

In most instances, the carbonaceous fuel elements should be capable of being ignited by a conventional cigarette lighter without the use of an oxidizing agent. Burning characteristics of this type may generally be obtained from a cellulosic material which has been pyrolyzed at temperatures between about 400° C. to about 1000° C., preferably between about 500° C. to about 950° C., most preferably at about 750° C., in an inert atmosphere or under a vacuum. The pyrolysis time is not believed to be critical, as long as the temperature at the center of the pyrolyzed mass has reached the aforesaid temperature range for at least a few, e.g., about 15, minutes. A slow pyrolysis, employing gradually increasing temperatures over many hours, is believed to produce a uniform material with a high carbon yield. Preferably, the pyrolyzed material is then cooled, ground to a fine powder, and heated in an inert gas stream at a temperature between about 650° C. to 750° C. to remove volatiles prior to further processing.

While undesirable in most cases, carbonaceous materials which require the use of an oxidizing agent to render them ignitable by a cigarette lighter are within the scope of this invention, as are carbonaceous materials which require the use of a glow retardant or other type of combustion modifying agent. Such combustion modifying agents are disclosed in many patents and publications and are well known to those of ordinary skill in the art.

In certain preferred embodiments, the carbonaceous fuel elements are substantially free of volatile organic material. By that, it is meant that the fuel element is not purposely impregnated or mixed with substantial amounts of volatile organic materials, such as volatile aerosol forming or flavoring agents, which could degrade in the burning fuel. However, small amounts of materials, e.g., water, which are naturally adsorbed by the carbon in the fuel element, may be present therein. Similarly, small amounts of aerosol forming substances may migrate from the aerosol generating means and thus may also be present in the fuel.

In other preferred embodiments, the fuel element may contain minor amounts of tobacco, tobacco extracts, and/or other materials, primarily to add flavor to the aerosol. Amounts of these additives may range up to about 25 weight percent or more, depending upon the additive, the fuel source, and the desired burning characteristics. Tobacco and/or tobacco extracts may be added to carbonaceous fuel elements e.g., at about 10 to 20 weight percent, thereby providing tobacco flavors to the mainstream and tobacco aroma to the sidestream akin to a conventional cigarette, without affecting the Ames test activity of the product.

A preferred carbonaceous fuel element is a pressed or extruded mass of carbon prepared from a powdered carbon and a binder, by conventional pressure forming or extrusion techniques. A preferred activated carbon for such a fuel element is PCB-G, and a preferred nonactivated carbon is PXC, both available from Calgon Carbon Corporation, Pittsburgh, Pa. Other preferred nonactivated carbons for pressure forming are prepared from pyrolized cotton or pyrolized papers, such as Grande Prairie Canadian Kraft, available from the Buckeye Cellulose Corporation of Memphis, Tenn.

The binders which may be used in preparing such a fuel element are well known in the art. A preferred binder is sodium carboxymethylcellulose (SCMC), which may be used alone, which is preferred, or in conjunction with materials such as sodium chloride, vermiculite, bentonite, calcium carbonate, and the like. Other useful binders include gums, such as guar gum, and other cellulose derivatives, such as methylcellulose and carboxymethylcellulose (CMC).

A wide range of binder concentrations can be utilized. Preferably, the amount of binder is limited to minimize contribution of the binder to undesirable combustion products. On the other hand, sufficient binder must be included to hold the fuel element together during manufacture and use. The amount used will thus depend on the cohesiveness of the carbon in the fuel.

In general, an extruded carbonaceous fuel may be prepared by admixing from about 50 to 99 weight percent, preferably about 80 to 95 weight percent, of the carbonaceous material, with from 1 to 50 weight percent, preferably about 5 to 20 weight percent of the binder, with sufficient water to make a paste having a stiff dough-like consistency. Minor amounts, e.g., up to about 35 weight percent, preferably about 10 to 20 weight percent, of tobacco, tobacco extract, and the like, may be added to the paste with additional water, if necessary, to maintain a stiff dough consistency. The dough is then extruded using a standard ram or piston type extruder into the desired shape, with the desired number and configuration of passageways, and dried, preferably at about 95° C. to reduce the moisture content to about 2 to 7 wt. percent. Alternatively, or additionally, the passageways and/or cavity may be formed using conventional drilling techniques. If desired, the lighting end of the fuel element may be tapered or reduced in diameter by machining, molding, or the like, to improve lightability.

A high quality fuel element also may be formed by casting a thin slurry of the carbon/binder mixture (with or without additional components) into a sheet, drying the sheet, regrinding the dried sheet into a powder, forming a stiff paste with water, and extruding the paste as described above.

If desired, carbon/binder fuel elements (without tobacco, and the like) may be pyrolyzed after formation, for example, to about 650° C. for two hours, to convert the binder to carbon and thereby form a virtually 100% carbon fuel source.

The fuel elements of the present invention also may contain one or more additives to improve burning, such as up to about 5 weight percent of sodium chloride to improve smoldering characteristics and as a glow retardant. Also, up to about 5, preferably from about 1 to 2, weight percent of potassium carbonate may be included to control flammability. Additives to improve physical characteristics, such as clays like kaolins, serpentines, attapulgites and the like also may be used.

Preferably, the carbonaceous fuel element is provided with one or more longitudinally extending passageways. These passageways help to control transfer of heat from the fuel element to the aerosol generating means, which is important both in terms of transferring enough heat to produce sufficient aerosol and in terms of avoiding the transfer of so much heat that the aerosol former is degraded. Generally, these passageways provide porosity and increase early heat transfer to the substrate by increasing the amount of hot gases which reach the substrate. They also tend to increase the rate of burning.

Generally, a large number of passageways, e.g., about 5 to 9 or more, especially with relatively wide spacings between the passageways, as in FIGS. 4A and 5A, produce high convective heat transfer, which leads to high aerosol delivery. A large number of passageways also generally helps assure ease of lighting.

High convective heat transfer tends to produce a higher CO output in the mainstream. To reduce CO levels, fewer passageways or a higher density fuel element may be employed, but such changes generally tend to make the fuel element more difficult to ignite, and to decrease the convective heat transfer, thereby lowering the aerosol delivery rate and amount. However, it has been discovered that with passageway arrangements which are closely spaced, as in FIG. 4B, such that they burn out or coalesce to form one passageway, at least at the lighting end, the amount of CO in the combustion products is generally lower than in the same, but widely spaced, passageway arrangement. Another preferred passageway arrangement is the configuration of FIG. 5B, which has been found to be particularly advantageous for low CO delivery and ease of lighting.

The aerosol generating means used in practicing this invention is physically separate from the fuel element. The term "physically separate" means that the aerosol generating means, which includes the aerosol forming materials, is not mixed with, or a part of, the fuel element. This arrangement helps reduce or eliminate thermal degradation of the aerosol forming substance and the presence of sidestream smoke. While not a part of the fuel, the aerosol generating means preferably abuts, is connected to, or is otherwise adjacent to the fuel element so that the fuel and the aerosol generating means are in a heat exchange relationship. Preferably, the conductive heat exchange relationship is achieved by providing a heat conducting member, preferably recessed from the lighting end of the fuel element, which efficiently conducts or transfers heat from the burning fuel element to the aerosol generating means.

The container for the aerosol generating means of the present invention comprises a heat conductive, preferably metallic container, in the form of a macrocapsule, a reaction chamber, or the like, which contains the aerosol former.

This heat conductive container is spaced no more than 40 mm, preferably no more than 15 mm, from the lighting end of the fuel element. Preferably, the fuel end of the conductive container forms the heat conducting member which preferably couples the fuel element to the aerosol generating means. Alternatively, a separate heat conducting member may be provided.

The preferred macrocapsule is generally tubular in shape, from about 2 to about 8 mm, preferably 3 to 7 mm in diameter and from about 2 to 60 mm, preferably from about 5 to 40 mm, most preferably from about 20 to 35 mm in length. The macrocapsule contains one or more aerosol forming substances dispersed within a suitable carrier, or one or more suitable aerosol forming substances without a carrier. Preferably, the fuel end of the macrocapsule overlaps or otherwise contacts the rear portion of the fuel element (e.g., about 2 to 4 mm) to provide for heat conduction between the fuel element and the aerosol generating means. However, the fuel end may be crimped to form a partially closed end, or it may be designed to avoid contact with the fuel element, although that is not believed to be desirable.

Normally, the mouth end of the macrocapsule is crimped in to form a wall and the macrocapsule is provided with passages to permit the flow of gases to the mouth end. These passages may be used to help control the pressure drop through the article. As illustrated in FIG. 6, the macrocapsule also may be crimped or shaped to help control the pressure drop, or to provide other desirable effects.

The reaction chamber, is similar to the macrocapsule, but is generally not a one piece (i.e., unitary) construction. The reaction chamber is preferably made up of up to three heat conductive components; (a) a forward heat cap; (b) a rearward heat cap; and (c) a peripheral heat conductive outer wrap. These three components interact to provide even distribution of heat from the burning fuel element to the aerosol forming substance or substances. The size and shape of the reaction chamber can vary depending upon the requirements of the particular smoking article. However, as a general rule, the sizes specified for the macrocapsule are applicable to the reaction chamber as well. The reaction chamber, like the macrocapsule, contains one or more carriers, if necessary, and one or more aerosol forming substances.

An especially preferred container for the aerosol generating means is the macrocapsule illustrated in FIGS. 6 and 6B. This capsule is advantageously utilized when the periphery of the capsule is surrounded by a tobacco jacket. As illustrated, the capsule is crimped along its rear portion, such that channels or grooves 77 are formed, along which vapors from the aerosol former may travel. Upon heating by the fuel element, such vapors flow from the aerosol generating means through passages 72, along the channels and into the surrounding tobacco jacket, extracting tobacco flavors and delivering the flavors to the user. In addition, the heat conducted from the burning fuel element by the metallic capsule assists in the extraction and/or absorption of the tobacco flavors into the vapor from the aerosol generating burning fuel element by the metallic capsule assists in the extraction and/or absorption of the tobacco flavors into the vapor from the aerosol generating means by bringing the tobacco flavor components closer to their vaporization temperatures. Preferably, the capsule has the rib-shape illustrated in FIG. 6B, but other shapes, which will allow the passage of vapors from the aerosol generating means to pass into, and freely travel through a peripheral tobacco jacket can be designed by the skilled artisan.

Preferably, the aerosol generating means includes one or more thermally stable materials which carry one or more aerosol forming substances. As used herein, a "thermally stable" material is one capable of withstanding the high, albeit controlled, temperatures, e.g., from about 400° C. to about 600° C., which may eventually exist near the fuel, without significant decomposition or burning. The use of such material is believed to help maintain the simple "smoke" chemistry of the aerosol, as evidenced by a lack of Ames test activity in the preferred embodiments. While not preferred, other aerosol generating means, such as heat rupturable microcapsules, or solid aerosol forming substances, are within the scope of this invention, provided they are capable of releasing sufficient aerosol forming vapors to satisfactorily resemble tobacco smoke.

Thermally stable materials which may be used as the carrier or substrate for the aerosol forming substance are well known to those skilled in the art. Useful carriers should be porous, and must be capable of retaining an aerosol forming compound and releasing a potential aerosol forming vapor upon heating by the fuel. Useful thermally stable materials include adsorbent carbons, such as porous grade carbons, graphite, activated, or non-activated carbons, and the like, such as PC-25 and PG-60 available from Union Carbide Corp., Danbury, Conn., as well as SGL carbon, available from Calgon. Other suitable materials include inorganic solids, such as ceramics, glass, alumina, vermiculite, clays such as bentonite, and the like. Carbon and alumina substrates are preferred.

An especially useful alumina substrate is available from the Davison Chemical Division of W. R. Grace & Co. under the designation SMR-14-1896. Before use, this alumina is sintered at elevated temperatures, e.g., greater than 1000° C., washed and dried.

It has been found that suitable particulate substrates also may be formed from carbon, tobacco, or mixtures of carbon and tobacco, into densified particles using a machine made by Fuji Paudal KK of Japan, and sold under the trade name of "Marumerizer." This apparatus is described in German Patent No. 1,294,351 and U.S. Pat. No. 3,277,520 (now reissued as No. 27,214) as well as Japanese published specification No. 8684/1967.

The aerosol forming substance or substances used in the articles of the present invention must be capable of forming an aerosol at the temperatures present in the container for the aerosol generating means upon heating by the burning fuel element. Such substances preferably will be composed of carbon, hydrogen and oxygen, but they may include other materials. Such substances can be in solid, semisolid, or liquid form. The boiling or sublimation point of the substance and/or the mixture of substances can range up to about 500° C. Substances having these characteristics include: polyhydric alcohols, such as glycerin, triethylene glycol, and propylene glycol, as well as aliphatic esters of mono-, di-, or polycarboxylic acids, such as methyl stearate, dodecandioate, dimethyl tetradodecandioate, and others.

The preferred aerosol forming substances are polyhydric alcohols, or mixtures of polyhydric alcohols. More preferred aerosol formers are selected from glycerin, triethylene glycol and propylene glycol.

When a substrate material is employed as a carrier, the aerosol forming substance may be dispersed on or within the substrate in a concentration sufficient to permeate or coat the material, by any known technique. For example, the aerosol forming substance may be applied full strength or in a dilute solution by dipping, spraying, vapor deposition, or similar techniques. Solid aerosol forming components may be admixed with the substrate material and distributed evenly throughout prior to formation of the final substrate.

While the loading of the aerosol forming substance will vary from carrier to carrier and from aerosol forming substance to aerosol forming substance, the amount of liquid aerosol forming substances may generally vary from about 20 mg to about 120 mg, preferably from about 35 mg to about 85 mg, and most preferably from about 45 mg to about 65 mg. As much as possible to the aerosol former carried on the substrate should be delivered to the user as WTPM. Preferably, above about 2 weight percent, more preferably above about 15 weight percent, and most preferably above about 20 weight percent of the aerosol former carried on the substrate is delivered to the user as WTPM.

The aerosol generating means also may include one or more volatile flavoring agents, such as methanol, vanillin, artificial coffee, tobacco extracts, nicotine, caffeine, liquors, and other agents which impart flavor to the aerosol. It also may include any other desirable volatile solid or liquid materials. Alternatively, these optional agents may be placed between the container for the aerosol generating means and the mouth end, such as in a separate substrate or chamber or coated within the passageway leading to the mouth end, or in the optional tobacco charge.

One particularly preferred aerosol generating means comprises the aforesaid alumina substrate containing spray dried tobacco extract, tobacco flavor modifiers, such as levulinic acid, one or more flavoring materials, and an aerosol forming material, such as glycerin. In certain preferred embodiments, this substrate may be mixed with densified tobacco particles, such as those produced on a "Marumerizer", which particles may also be impregnated with an aerosol forming material.

As shown in the illustrated embodiments, a charge of tobacco containing material may be employed downstream from the fuel element. In such cases, hot vapors are swept through the tobacco to extract and distill the volatile components from the tobacco, without combustion or substantial pyrolysis. Thus, the user receives an aerosol which contains the tastes and flavors of natural tobacco without the numerous combustion products produced by a conventional cigarette.

Articles of the type disclosed herein may be used or may be modified for use as drug delivery articles, for delivery of volatile pharmacologically or physiologically active materials such as ephedrine, metaproterenol, terbutaline, or the like.

The heat conducting material preferably employed in constructing the container for the aerosol generating means and for the heat conducting member of this invention is typically a metallic (e.g., aluminum) tube, strip, or foil, varying in thickness from less than about 0.01 mm to about 0.2 mm, or more. The thickness and/or the type of conducting material may be varied (e.g., other metals or Grafoil, from Union Carbide) to achieve virtually any desired degree of heat transfer. As shown in the illustrated embodiments, the heat conducting material preferably contacts or overlaps the rear portion of the fuel element, and forms the container which encloses the aerosol forming substance. However, more than one member or material may be employed to perform these functions.

Preferably, the heat conducting member extends over no more than about one-half the length of the fuel element. More preferably, the heat conducting member overlaps or otherwise contacts no more than about the rear 5 mm of the fuel element. Preferred recessed members of this type do not interfere with the lighting or burning characteristics of the fuel element. Such members help to extinguish the fuel element, and any combustable materials which peripherally surround the fuel element, when they have been consumed to the point of contact with the conducting member by acting as a heat sink. These members also do not protrude from the lighting end of the article even after the fuel element has been consumed.

The insulating members employed in practicing the invention are preferably formed into a resilient jacket from one or more layers of an insulating material. Advantageously, this jacket is at least about 0.5 mm thick, preferably at least about 1 mm thick, more preferably between about 1.5 to 2 mm thick. Preferably, the jacket extends over more than about half, if not all of the length of the fuel element. More preferably, it also extends over substantially the entire outer periphery of the fuel element and the capsule for the aerosol generating means. As shown in the embodiment of FIG. 6, different materials may be used to insulate these two components of the article.

Insulating materials which may be used in accordance with the present invention generally comprise inorganic or organic fibers such as those made out of glass, alumina, silica, vitreous materials, mineral wool, carbons, silicons, boron, organic polymers, cellulosics, and the like, including mixtures of these materials. Nonfibrous insulating materials, such as silica aerogel, pearlite, glass, and the like may also be used. Preferred insulating members are resilient, to help simulate the feel of a conventional cigarette. These materials act primarily as an insulating jacket, retaining and directing a significant portion of the heat formed by the burning fuel element to the aerosol generating means. Because the insulating jacket becomes hot adjacent to the burning fuel element, to a limited extent, it also may conduct heat toward the aerosol generating means.

The currently preferred insulating fibers are ceramic fibers, such as glass fibers. Two suitable glass fibers are available from the Manning Paper Company of Troy, N.Y., under the designations, Manniglas 1000 and Manniglas 1200. When possible, glass fiber materials having a low softening point, e.g., below about 650° C., are preferred. The preferred glass fibers include experimental materials produced by Owens-Corning of Toledo, Ohio under the designations 6432 and 6437.

Several commercially available inorganic insulating fibers are prepared with a binder e.g., PVA, which acts to maintain structural integrity during handling. These binders, which would exhibit a harsh aroma upon heating, should be removed, e.g., by heating in air at about 650° C. for up to about 15 min. before use herein. If desired, pectin, at up to about 3 wt. percent, may be added to the fibers to provide mechanical strength to the jacket without contributing harsh aromas.

Alternatively, the insulating material may be replaced, in whole or in part, by tobacco, either loosely packed or tightly packed. The use of tobacco as a substitute for a part or all of the insulating jacket serves an additional function by adding tobacco flavors to the mainstream aerosol and producing a tobacco sidestream aroma, in addition to acting as an insulator. In preferred embodiments where the tobacco jacket encompasses the aerosol generating means, the jacket acts as a nonburning insulator, as well as contributing tobacco flavors to the mainstream aerosol. In embodiments where the tobacco encircles the fuel, the tobacco is preferably consumed only to the extent that the fuel element is consumed, i.e., up to about the point of contact between the fuel element and the aerosol generating means. This may be achieved by compressing the tobacco around the fuel element and employing a heat member between the tobacco jacket and the rear portion of the fuel element and/or the aerosol forming material. It also may be achieved by treating the cigarette paper overwrap and/or the tobacco with materials which help extinguish the tobacco at the point were it overlaps the container for the aerosol generating means.

When the insulating means comprise fibrous materials other than tobacco, a barrier means may be employed at the mouth end of the insulating jacket, or elsewhere near the mouth end of the article. One such barrier means comprises an annular member of high density cellulose acetate tow which abuts the fibrous insulating means and which is sealed at either end, with for example glue, to block air flow through the tow.

In most embodiments of the invention, the fuel and aerosol generating means will be attached to a mouthend piece, although a mouthend piece may be provided separately, e.g., in the form of a cigarette holder. This element of the article provides the enclosure which channels the vaporized aerosol forming substance into the mouth of the user. Due to its length, about 35 to 50 mm, it also keeps the hot fire cone away from the mouth and fingers of the user, and provides sufficient time for the hot aerosol to cool before reaching the user.

Suitable mouthend pieces should be inert with respect to the aerosol forming substances, should have a water or liquid proof inner layer, should offer minimum aerosol loss by condensation or filtration, and should be capable of withstanding the temperature at the interface with the other elements of the article. Preferred mouthend pieces include the cellulose acetate tube, optionally containing a plastic inner tube, as illustrated in FIGS. 1–6, in which the cellulose acetate acts as a resilient outer member to help simulate the feel of a conventional cigarette in the mouth end portion of the article. Other suitable mouthend piece will be apparent to those of ordinary skill in the art.

The mouthend pieces of the invention may include an optional "filter" tip, which is used to give the article the appearance of the conventional filtered cigarette. Such filters include low efficiency cellulose acetate filters and hollow or baffled plastic filters, such as those made of polypropylene. Such filters do not appreciably interfere with aerosol delivery.

The entire length of the article or any portion thereof may be overwrapped with one or more different cigarette papers. Preferred papers at the mouth end should simulate conventional tipping paper. Preferred papers at the fuel element end should not openly flame during burning of the fuel element. In addition, the paper should have controllable smolder properties and should produce a grey, cigarette-like ash.

In those embodiments utilizing an insulating jacket wherein the paper burns away from the jacketed fuel element, maximum heat transfer is achieved because air flow to the fuel source is not restricted. However, papers can be designed or engineered to remain wholly or partially intact upon exposure to heat from the burning fuel element. Such papers provide the opportunity to restrict air flow to the burning fuel element, thereby controlling the temperature at which the fuel element burns and the subsequent heat transfer to the aerosol generating means.

To reduce the burning rate and temperature of the fuel element, thereby maintaining a low $CO/CO_2$ ratio, a non-porous or zero-porosity paper treated to be slightly porous, e.g., non-combustible mica paper with a plurality of holes therein, may be employed as the overwrap layer. Such a paper controls heat delivery, especially in the middle puffs (i.e., 4–6).

To maximize aerosol delivery, which otherwise would be diluted by radial (i.e., outside) air infiltration through the article, a non-porous paper may be used from the aerosol generating means to the mouth end.

Papers such as these are known in the cigarette and/or paper arts and mixtures of such papers may be employed for various functional effects. Preferred papers used in the articles of the present invention include ECUSTA 01788 and 646 plug wrap, both manufactured by Ecusta of Pisgah Forest, N.C., and Kimberly-Clark's KC-63-5, P 878-5, P 878-16-2 and 780-63-5 papers.

The aerosol produced by the preferred articles of the present invention is chemically simple, consisting essentially of air, water, oxides of carbon, the aerosol former, any desired flavors or other desired volatile materials, and trace amounts of other materials. The WTPM produced by the preferred articles of this invention has no measurable mutagenic activity as measured by the Ames test, i.e., there is no significant dose response relationship between the WTPM produced by preferred articles of the present invention and the number of revertants occurring in standard test microorganisms exposed to such products. According to the proponents of the Ames test, a significant dose dependent response indicates the presence of mutagenic materials in the products tested. See Ames et al., *Mut. Res.*, 31:347–364 (1975); Nagao et al., *Mut. Res.*, 42:335 (1977).

A further benefit from the preferred embodiments of the present invention is the relative lack of ash produced during use in comparison to ash from a conventional cigarette. As the preferred carbon fuel source is burned, it is essentially converted to oxides of carbon, with relatively little ash generation, and thus there is no need to dispose of ashes while using the article.

The smoking article of the present invention will be further illustrated with reference to the following examples which aid in the understanding of the present invention, but which are not to be construed as limitations thereof. All percentages reported herein, unless otherwise specified, are percent by weight. All temperatures are expressed in degrees Celsius. In all instances, the articles have a diameter of about 7 to 8 mm, the diameter of a conventional cigarette.

EXAMPLE 1

A smoking article was constructed with a 15 mm long, 7.5 mm diameter fibrous fuel element of carbonized cotton fibers, having a 1.0 mm axial hole, substantially as illustrated in FIG. 1. The carbonized cotton fibers were formed by tightly braiding together four slivers of cotton with cotton string to form a rope having a diameter of about 0.4 in. (about 10 mm). This material was placed in a nitrogen atmosphere furnace which was heated to 950° C. It took about 1½ hours to reach that temperature, which was then held for about ½ hour. A 15 mm piece was cut from this pyrolyzed material to be used as the fuel element. A 1 mm axial hole was made through the fuel element with a probe.

The macrocapsule was formed from a 15 mm long piece of 4 mil (0.10 mm) thick aluminum foil, which was crimped to form a 12 mm long capsule. This macrocapsule was loosely filled with 100 mg of PG-60, a granulated graphite obtained from Union Carbide, and 50 mg of blended tobacco. The granular carbon was impregnated with 60 mg of a 1:1 mixture of propylene glycol and glycerol. The macrocapsule, the fuel element, and the mouthend piece were united by an 85 mm long piece of conventional cigarette paper.

EXAMPLE 2

A smoking article was constructed in accordance with the embodiment of FIG. 2 with a 7 mm long pressed carbon fuel element containing 90% PXC carbon and 10% SCMC. The center passageway was 0.040 in. (1.02 mm) in diameter. This fuel plug was inserted into a 17 mm long aluminum foil lined paper tube (consisting of a 0.35 mil (0.0089 mm) layer of aluminum foil inside a 4.25 mil (0.108 mm) layer of white spirally wound paper) such that 3 mm of the fuel element was inside the tube. An 8 mm diameter disc of 3.5 mil (0.089 mm) aluminum foil, with a 0.049 in. (1.24 mm) diameter center passageway, was inserted into the other end of the tube and butted against the end of the fuel element.

Union Carbide PG-60 carbon was granulated and sieved to a particle size of −6 to +10 mesh. 80 mg of this material was used as the substrate. 80 mg of a 1:1 mixture of glycerin and propylene glycol was loaded on this substrate. The impregnated granules were inserted into the foil tube and rested against the foil disk on the end of the fuel element. 50 mg of blended tobacco was loosely placed against the substrate granules. An additional foil disk with a 0.049 in. (1.24 mm) central passageway was inserted into the foil tube on the mouthend of the tobacco. A long hollow cellulose acetate rod with a hollow polypropylene tube was inserted 3 mm into the foil lined tube. A second foil lined tube was inserted over the cellulose acetate rod and butted against the end of the 17 mm foil lined tube.

This model delivered 11.0 mg of aerosol in the first three puffs when "smoked" under FTC conditions. Total aerosol delivery for nine puffs was 24.9 mg.

EXAMPLE 3

A smoking article substantially as illustrated in FIG. 3 was prepared in the following manner. A 9.5 mm long, 4.5 mm diameter carbon fuel element with four wedge shaped central passageways was extruded from a mixture of 10% SCMC, 5% potassium carbonate, and 85% carbonized paper mixed with 10% water. The mixture had a dough-like consistency and was fed into an extruder. The extruded material was cut to length after drying at 80° C. overnight.

The macrocapsule was made from a 22 mm long piece of 0.0089 mm thick aluminum, formed into a cylinder of 4.5 mm inner diameter. One end of the capsule was crimped to form a walled end with a passageway. The macrocapsule was filled with (a) 70 mg of vermiculite containing 50 mg of a 1:1 mixture of propylene glycol and glycerin, and (b) 30 mg of Burley tobacco to which 6% glycerine and 6% propylene glycol had been added.

The fuel element and the macrocapsule were joined by inserting the fuel element about 2 mm into the open end of the macrocapsule. A 35 mm long polypropylene tube of 4.5 mm inner diameter was inserted over the walled end of the macrocapsule. The fuel element, macrocapsule and polypropylene tube were thus joined to form a 65 mm long, 4.5 mm diameter segment. This segment was wrapped with several layers of Manniglas 1000 from the Manning Paper Company, until a circumference of 24.7 mm was reached (i.e., the circumference of a conventional cigarette.) The unit was then combined with a 5 mm long cellulose acetate filter and overwrapped with cigarette paper.

When ignited and placed horizontally on a piece of tissue paper, the article neither ignited nor scorched the tissue paper.

EXAMPLE 4

The smoking article illustrated in FIG. 4 was made from an extruded carbon fuel element in the following manner.

A. Fuel Element Preparation

Grand Prairie Canadian Kraft paper made from hardwood and obtained from Buckeye Cellulose Corp., Memphis, Tenn., was shredded and placed inside a 9" diameter, 9" deep stainless steel furnace. The furnace chamber was flushed with nitrogen, and the furnace temperature was raised to 200° C. and held for 2 hours. The temperature in the furnace was then increased at a rate of 5° C. per hour to 350° C. and was held at 350° C. for 2 hours. The temperature of the furnace was then increased at 5° C. per hour to 650° C. to further pyrolize the cellulose. Again the furnace was held at temperature for 2 hours to assure uniform heating of the carbon. The furnace was then cooled to room temperature and the carbon was ground into a fine powder (less than 400 mesh) using a "Trost" mill. This powdered carbon had a tapped density of 0.6 grams/cubic centimeter and hydrogen plus oxygen level of 4%.

Nine parts of this carbon powder was mixed with one part of SCMC powder, $K_2CO_3$ was added at 1 to 2 wt. percent, and water was added to make a thin slurry, which was then cast into a sheet and dried. The dried sheet was then reground into a fine powder and sufficient water was added to make a plastic mix which was stiff enough to hold its shape after extrusion, e.g., a ball of the mix will show only a slight tendency to flow in a one day period. This plastic mix was then loaded into a room temperature batch extruder. The female extrusion die for shaping the extrudant had tapered surfaces to facilitate smooth flow of the plastic mass. A low pressure (less than 5 tons per square inch or $7.03\times10^6$ kg per square meter) was applied to the plastic mass to force it through a female die of 4.6 mm diameter. The wet rod was then allowed to dry at room temperature overnight. To assure that the rod was completely dry it was then placed into an oven at 80° C. for two hours. This dried rod had a density of about 0.9 gm/cc, a diameter of 4.5 mm, and an out of roundness of approximately 3%. The dry, extruded rod was cut into 10 mm lengths and seven 0.5 mm passageways were drilled through the length of the rod as illustrated in FIG. 4A.

B. Assembly

The macrocapsules were prepared from 30 mm long spirally wound aluminum tubes obtained from Niemand, Inc., having a diameter of about 4.5 mm. One end of each of these tubes was crimped to form a container having an end with at least one small passageway. Approximately 180 mg of PG-60, a granulated graphite, was used to fill each of the containers. This substrate material was loaded with approximately 75 mg of a 1:1 mixture of glycerin and propylene glycol. After the macrocapsules were filled, each was joined to a fuel element by inserting about 2 to 3 mm of the fuel rod into the open end of the macrocapsule. The fuel element-/macrocapsule combination was then joined to a 35 mm long polypropylene tube of 4.5 mm internal diameter by inserting one end of the tube over the walled end of the macrocapsule forming a "core unit."

Each of these core units was placed on a sheet of Manniglas 1200 pretreated at about 600° C. for up to about 15 min. in air to eliminate binders, and rolled until the article was approximately the circumference of a cigarette. An additional double wrap of Manniglas 1000 was applied around the Manniglas 1200. The ceramic fiber jacket was cut away from the mouth end 10 mm of the polypropylene tube so that a 10 mm long annular segment of cellulose acetate filter material would fit over the mouth end of the polypropylene tube. The mouth end of this segment was coated with a conventional adhesive to block air flow through the filter material. A conventional cellulose acetate filter piece of 10 mm length was butted against the adhesive. The entire unit was then wrapped with ECUSTA 01788 perforated cigarette paper, and a conventional tipping paper was applied at the mouth end.

EXAMPLE 5

Core units were prepared in a manner similar to that described in Example 4, with extruded fuel elements 8 mm long and 5 mm in diameter having nine passageways as shown in FIG. 5A. The peripheral jacket employed consisted of tobacco instead of glass fibers. Such jacket was made by using a metal rod to form a 5 mm central passageway in a non-filtered cigarette, followed by insertion of the fuel element/capsule combination into the passageway, forming a jacketed piece. The size of the conventional cigarette jacket was chosen such that it extended from the lighting end of the fuel element to near the mouth end of the capsule. The jacketed end of the article was overwrapped with Kimberly Clark P 878-5 paper.

A cellulose acetate mouthend piece with a polypropylene inner tube and a white nonporous plug wrap was abutted against the jacketed portion of the article, and the sections were joined by a paper overwrap.

Similar smoking articles have also been prepared with tobacco, either mixed with or used in lieu of the substrate, with similar results.

Similar smoking articles have also been prepared with tobacco as a part of the fuel element, providing tobacco flavors to the aerosol.

EXAMPLE 6

Smoking articles were prepared in a manner similar to Example 4, but the substrate material was a specially treated alumina, prepared as follows:

High surface area alumina (surface area=280 $m^2/g$) from W. R. Grace & Co. (designated SMR-14-1896), having a mesh size of from −8 to +14 (U.S.) was sintered at a soak temperature above about 1400° C., preferably from about 1400° to 1550° C., for about one hour and cooled. The alumina was washed with water and dried. The alumina (640 mg) was treated with an aqueous solution containing 107 mg of spray dried flue cured tobacco extract (prepared as described below) and dried to a moisture content of from about 1 to 5, preferably about 3.5, weight percent. This material was then treated with a mixture of 233 mg of glycerin and 17 mg of a flavor component obtained from Firmenich, Geneva, Switzerland, under the designation T69-22. The capsule was filled with a 1:1 mixture of the treated alumina and densified (i.e., Marumerized) flue cured tobacco having a density of about 0.8 g/cc and loaded with about 15 wt. percent glycerin.

The tobacco extract used in this example was prepared as follows. Tobacco was ground to a medium dust and extracted with water in a stainless steel tank at a concentration of from about 1 to 1.5 pounds tobacco per gallon water. The extraction was conducted at ambient temperature using mechanical agitation for from about 1 hour to about 3 hours. The admixture was centrifuged to remove suspended solids and the aqueous extract was spray dried by continuously pumping the aqueous solution to a conventional spray dryer, such as an Anhydro Size No. 1, at an inlet temperature of from about 215°-230° C. and collecting the dried powder material at the outlet of the drier. The outlet temperature varied from about 82°-90° C.

EXAMPLE 7

The fuel source (7 mm long, 5 mm o.d.) was prepared in a manner similar to that described in Example 4, but 12 holes (each about 0.5 mm diameter) were drilled near the peripheral edge, as shown in FIG. 6A, and a central passageway of from about 1 to 2 mm in diameter was drilled through the fuel element using a No. 44 drill bit.

The macrocapsule was prepared from the aluminum tubing of Example 1, i.e., 4.5 mm outer diameter drawn aluminum, about 30 mm in length. This tubing was drawn down (i.e., reduced in diameter by stretching) for about 3 mm at one end to a diameter of about 2 mm. The drawn end of the capsule was cut to about a 2 mm length, leaving a passageway open into the capsule.

Beyond the 2 mm drawn end, the capsule retained the original 4.5 mm diameter for about 22 mm. The mouth end of the capsule was sealed by crimping about 2 mm of the aluminum together. A series of three holes were created in the capsule about 1 mm behind the shoulder formed by the size change (i.e., the reduced diameter transition) using a 26 gauge syringe needle. An additional hole was created in the sealed end of the capsule using the same needle. This capsule was filled with about 200 mg of PG-60 granulated graphite substrate bearing about 28 weight percent glycerin.

The 2 mm drawn end of the capsule was inserted into the rear of the central passageway of the fuel element up to the point where the elements abutted. This combination of drawn capsule and fuel element was used as a "core element" having a length of about 27 mm.

A 27 mm long tobacco rod with a cigarette paper wrap (e.g., from a non-filtered cigarette) was modified with a probe to compress the tobacco and to provide a 4.5 mm central passageway and a Mylar tube (about 4.5 mm diameter) was placed in the passage to hold the tobacco in place.

The core element was inserted into the tobacco rod causing the Mylar tube to exit at the mouth end. A cellulose acetate tube, having attached thereto a filter element, as utilized in Example 1, was abutted against the tobacco rod and the elements were connected with a section of cigarette paper.

At the location of the shoulder of the capsule, a band of sodium silicate was painted on the cigarette paper wrap to prevent the burning of the tobacco jacket by heat from the fuel source.

The entire article was overwrapped with cigarette paper.

Articles of this type delivered an average of about 24 mg WTPM, and about 13.5 mg CO when measured over ten puffs at a puff frequency of 30 seconds, a puff duration of 2 seconds, and a puff volume of 50 ml.

EXAMPLE 8

A smoking article of the type illustrated in FIG. 5 was prepared as follows.

The fuel source (7 mm long, 5.1 mm o.d.) was prepared in a manner similar to that described in Example 4, but 12 holes (each about 0.6 mm diameter) were drilled near the peripheral edge as shown in FIG. 6A.

The macrocapsule was prepared from the aluminum tubing of Example 1, i.e., 4.5 mm outer diameter drawn aluminum, about 30 mm in length. This tubing was sealed (by crimping) at one end. The sealed capsule (28 mm in length) was drawn so that 24 mm of the sealed, i.e., mouth end, portion of the capsule was reduced in diameter to about 4 mm, while 4 mm of the open, i.e., fuel end was expanded to about 5.1 mm in outer diameter. This was accomplished on a punch having a pin of diameter equal to that desired for the mouth end of the capsule and a wider diameter at the fuel element end.

Two slits (15 mm long) were cut into the mouth end portion of the capsule (spaced 180°). The cuts were made tangentially such that the openings flared out from the side of the capsule about 1 mm and such that the substrate would not fall out.

The capsule was filled with about 200 mg of PG-60 granulated graphite substrate bearing about 28 weight percent glycerin. The fuel element was inserted into the open end of the capsule, to a depth of about 2 mm.

A tobacco rod of from about 30 to 35 mm in length (e.g., from a non-filtered cigarette) was modified with a stepped probe to form a longitudinal passageway of about 5.6 mm diameter for about 10 mm, and a passageway of about 4.3 mm for the remaining length of the rod. This tobacco rod was connected by a paper wrap to a cellulose acetate mouthend piece (30 mm) having a conventional filter element (10 mm).

The fuel element/capsule combination was inserted into the passageway in the tobacco rod and the entire article was overwrapped with conventional cigarette paper.

EXAMPLE 9

A preferred smoking article of the present invention, of the type illustrated in FIG. 6, was prepared in the following manner.

The fuel element (10 mm long, 4.5 mm o.d.) having an apparent (bulk) density of about 0.86 g/cc, was prepared with 10 wt. percent spray dried flue cured tobacco extract (preparation described below) in addition to carbon, SCMC binder (10 wt. percent) and $K_2CO_3$ (1 wt. percent). The carbon was prepared from Grand Prairie Canadian Kraft Paper made from hardwood and obtained from Buckeye Cellulose Corp., Memphis, Tenn., using a gradually increasing carbonizing temperature of about 5° C. per hour in a non-oxidizing atmosphere, to a maximum carbonizing temperature of 750° C. After cooling, the carbon was ground to a mesh size of minus 200. The powdered carbon was then heated to a temperature of 650° C. to 750° C. to remove volatiles. The fuel element was extruded with seven holes (each about 0.6 mm diameter) in a closely spaced arrangement (similar to FIG. 4B) with a core diameter (i.e., the diameter of the smallest circle which will circumscribe the holes in the fuel element) of about 2.6 mm and spacing between the holes of about 0.3 mm.

The macrocapsule was prepared from drawn aluminum tubing, about 30 mm in length, having an outer diameter of about 4.5 mm. The rear 2 mm of the capsule was crimped to seal the mouth end of the capsule. At the mouth end, four equally spaced grooves were indented in the side of the capsule, each to a depth of about 0.75 mm to afford a "rib-shaped" capsule similar to that illustrated in FIG. 6B. This was accomplished by inserting the capsule into a die having four equally spaced wheels of about 0.75 mm depth located such that the rear 18 mm of the capsule was grooved to afford four equally spaced channels. Four holes (each about 0.72 mm diameter) were made in the capsule at the transition between the ungrooved portion of the capsule and each of the grooves (as shown in FIGS. 6 and 6B). In addition, a central hole (d=about 0.72 mm) was made in the sealed end of the capsule, approximately 17 mm from the holes at the fuel end of the grooves.

The tobacco extract used in this example was prepared as follows. Tobacco was ground to a medium dust and extracted with water in a stainless steel tank at a concentration of from about 1 to 1.5 pounds tobacco per gallon water. The extraction was conducted at ambient temperature using mechanical agitation for from about 1 hour to about 3 hours. The admixture was centrifuged to remove suspended solids and the aqueous extract was spray dried by continuously pumping the aqueous solution to a conventional spray dryer, such as an Anhydro Size No. 1, at an inlet temperature of from about 215°-230° C. and collecting the dried powder material at the outlet of the drier. The outlet temperature varied from about 82°-90° C.

High surface area alumina (surface area=280 $m^2/g$) from W. R. Grace & Co. (designated SMR-14-1896), having a mesh size of from −8 to +14 (U.S.) was sintered at a soak temperature above about 1400° C., preferably from about 1400° to 1550° C., for about one hour and cooled. The alumina was washed with water and dried. The alumina (640 mg) was treated with an aqueous solution containing 107 mg of spray dried flue cured tobacco extract and dried to a moisture content of from about 1 to 5, preferably about 3.5, weight percent. This material was then treated with a mixture of 233 mg of glycerin and 17 mg of a flavor component obtained from Firmenich, Geneva, Switzerland, under the designation T69-22 (or an equivalent). The capsule was filled with a 1:1 mixture of the treated alumina and densified (i.e., Marumerized) flue cured tobacco having a density of about 0.8 g/cc and loaded with about 15 wt. percent glycerin.

The fuel element was inserted into the open end of the filled macrocapsule to a depth of about 3 mm. The fuel element-macrocapsule combination was overwrapped at the fuel element end with a 10 mm long, glass fiber jacket of Owens-Corning 6437 (having a softening point of about 640° C.), with 3 wt. percent pectin binder, to a diameter of about 8 mm and overwrapped with Ecusta 646 plug wrap.

An 8 mm diameter tobacco rod (28 mm long) with an Ecusta 646 plug wrap overwrap was modified to have a longitudinal passageway (about 4.5 mm diameter) therein. The jacketed fuel element-macrocapsule combination was inserted into the tobacco rod passageway until the glass fiber jacket abutted the tobacco jacket. The glass fiber and tobacco sections were overwrapped with Kimberly-Clark P 878-16-2 paper.

A cellulose acetate mouthend piece (30 mm long) overwrapped with Ecusta 646 plug wrap and containing a 28 mm long polypropylene tube, recessed 2 mm from the fuel element end (as illustrated in FIG. 6) was joined to a filter element (10 mm long) having an overwrap of Ecusta 646 plug wrap, by P 878-16-12 paper. This mouthend piece section was joined to the jacketed fuel element-macrocapsule section by tipping paper.

During use, heated air and gases enter the tobacco jacket through the glass fiber jacket and through the holes in the capsule. A portion of the aerosol forming material also enters the tobacco jacket through the holes in the capsule.

Alternatively, the embodiment described herein may be modified to incorporate one or more of the following changes: (a) levulinic acid, at about 0.7 weight percent, may be added to the substrate; (b) the capsule need not contain Marumarized tobacco; (c) the flavor material(s) may be added to the tobacco jacket; (d) the capsule need not contain any tobacco flavor material(s); and (e) the shape of the capsule may be modified, e.g., the mouthend portion may be rectangular in lieu of lobe shaped, or the capsule may be a tube with a crimped mouthend, with or without the peripheral passageways.

What is claimed is:

1. A smoking article comprising:

(a) a carbonaceous fuel element;

(b) a physically separate aerosol generating means longitudinally disposed behind said fuel element and including an aerosol forming material; and (c) a heat conductive container adjacent the fuel element, which at least partially encloses the aerosol generating means, and which conducts heat from the fuel element to the aerosol generating means.

2. The article of claim 1, further comprising an insulating member which circumscribes at least a portion of the fuel element.

3. The article of claim 1, further comprising an insulating member which circumscribes at least a portion of the conductive container.

4. The article of claim 1, further comprising a barrier means separating the fuel element and the aerosol generating means.

5. The article of claim 4, wherein said barrier means is provided by the container.

6. The article of claim 5, wherein said container is crimped at its fuel element end.

7. The article of claim 1 or 2, wherein the container is crimped at its mouthend.

8. The article of claim 1 or 2, wherein the fuel end of the conductive container contacts the rear portion of the fuel element.

9. The article of claim 1, 2, or 3, wherein the container is spaced behind the lighting end of the fuel element.

10. The article of claim 1, 2, or 3, wherein the heat conductive container is in a conductive heat exchange relationship with the fuel element.

11. The article of claim 10, wherein the fuel end of the conductive container contacts the rear portion of the fuel element.

12. The article of claim 11, wherein the conductive container is provided with a plurality of passages for the aerosol forming materials.

13. A cigarette-type smoking article as recited in claim 10, wherein the fuel element is less than 30 mm in length.

14. A cigarette-type smoking article comprising:

(a) a combustible fuel element less than about 30 mm in length;

(b) a physically separate aerosol generating means including an aerosol forming material; and (c) a heat conductive container which at least partially encloses the aerosol forming material, said container contacting the fuel element being spaced being the lighting end of the fuel element and which assists in the transfer of heat from the fuel element to the aerosol forming material.

15. The article of claim 14, further comprising an insulating member which circumscribes at least a portion of the fuel element.

16. The article of claim 15, 21, 22, or 23, wherein the heat conductive container is in a conductive heat exchange relationship with the fuel element.

17. The article of claim 16, wherein the fuel end of the conductive container contacts the rear portion of the fuel element.

18. The article of claim 17, wherein the conductive container is a metallic tube provided with a plurality of passages for the aerosol forming materials.

19. The article of claim 16, wherein the fuel element contains carbon.

20. The article of claim 16, wherein the fuel element has a plurality of passageways.

21. The article of claim 14, further comprising an insulating member which circumscribes at least a portion of the conductive container.

22. The article of claim 21, further comprising an insulating member which circumscribes at least a portion of the fuel element.

23. The article of claim 14, wherein the fuel end of the conductive container contacts the rear portion of the fuel element.

24. The article of claim 14, 15, 21, 22, or 23, wherein the fuel element is carbonaceous.

25. The smoking article of claim 1, 2, 3, 14, 15, or 21 which article delivers at least about 0.6 mg of wet total particulate matter in the first three puffs under FTC smoking conditions.

26. The smoking article of claim 1, 2, 3, 14, 15, or 21, which article delivers an average of at least about 0.8 mg of wet total particulate matter for at least six puffs under FTC smoking conditions.

27. The smoking article of claim 1, 2, 3, 14, 15, or 21, wherein the conductive container is a metallic tube having a wall at the end remote from the fuel element and at least one passageway in the tube for the passage of the aerosol forming materials.

28. The smoking article of claim 1, 2, 3, 14, 15, or 21, wherein the aerosol produced has substantially no mutagenic activity as measured by the Ames test.

29. A smoking article comprising:

(a) a carbonaceous fuel element;

(b) a physically separate aerosol generating means longitudinally disposed behind said fuel element and including an aerosol forming material; and (c) a heat conductive container which at least partially encloses the aerosol forming material, and which conducts heat from the fuel element to the aerosol forming material.

30. The smoking article of claim 29, wherein the fuel element is less than about 30 mm in length prior to smoking.

31. The smoking article of claim 29, wherein the fuel element is less than about 15 mm in length prior to smoking.

* * * * *